US005779042A

United States Patent [19]

Kaneko

[11] Patent Number: 5,779,042

[45] Date of Patent: Jul. 14, 1998

[54] GOLF BAG

[75] Inventor: Nariie Kaneko, Osaka, Japan

[73] Assignee: Two and One Co., Ltd., Osaka, Japan

[21] Appl. No.: 881,203

[22] Filed: Jun. 24, 1997

[51] Int. Cl.[6] ..... A63B 55/00

[52] U.S. Cl. ..... 206/315.4; 150/159; 150/160; 206/315.2

[58] Field of Search ..... 206/315.3, 315.4, 206/315.5, 315.6, 443; 248/96; 150/159, 160

[56] References Cited

U.S. PATENT DOCUMENTS

| | | | |
|---|---|---|---|
| 2,128,546 | 4/1938 | Venmore | 206/315.6 X |
| 5,060,796 | 10/1991 | Brooks, III | 206/315.6 |
| 5,383,505 | 1/1995 | Cordasco, Jr. | 150/159 |
| 5,437,320 | 8/1995 | Sung | 206/315.4 X |

*Primary Examiner*—Allan N. Shoap
*Assistant Examiner*—Tri M. Mai
*Attorney, Agent, or Firm*—Wenderoth, Lind & Ponack, L.L.P.

[57] ABSTRACT

A golf bag having a flap for protecting the golf clubs therein from rain. The flap is designed such that it will not be an obstacle when clubs are inserted into or taken out of the bag when it is not raining. The golf bag has a cylindrical body having a top opening covered by a flap. The flap is inclined relative to the axis of the cylindrical body. The interior of the body is partitioned into three spaces by two sheets. Each of putters and irons are placed in one of the spaces of the smallest and medium depths whose depth is nearer to the length of each of the putters and irons so that the putters and irons will not bounce in the bag. The flap is formed with holes right over the third space. A resin pipe is fitted in each hole through which the shaft of a wood can pass. A wood head cover is secured to the protruding end of each resin pipe.

2 Claims, 3 Drawing Sheets

GOLF BAG

BACKGROUND OF THE INVENTION

This invention relates to a golf bag.

FIG. 3 shows a typical conventional golf bag. This golf bag is a substantially cylindrical member made of a weather-resistant sheet lined with resin plates. To one side is provided a pocket 21 which can accept not only items necessary for golf plays (such as golf gloves) but other personal belongings. The top 1*a* of the body of the golf bag is left open so that any of the club set (comprising putters P, irons I and woods W) can be easily taken out. In the figure, numeral 22 indicates a shoulder strap, and 23 a handle.

Since the top of this conventional golf bag is left open, in a rainy weather, rainwater can freely get into the bag, wetting the golf clubs therein, unless the bag has some means for preventing the entry of rainwater.

To protect the inside of the bag and the clubs therein from rain, a conventional golf bag has a bag-shaped hood 30 (shown by chain line in FIG. 3) attached to the bag body near its top 1*a* and large enough to cover the top opening and portions of the clubs protruding from the top opening. This hood 30 is detachably attached to the bag body near its top 1*a* by a fastener means such as buttons 30*a* or a Velcro fastener provided on the surface of the bag body near its top. In a rainy weather, the hood 30 is attached to the bag to cover the top opening 1*a*, thereby protecting the inside of the bag and the clubs from rain. In a fine weather, the hood 30 is detached from the bag body and put in the pocket 21 at the side of the bag body 1.

Whenever it begins raining, the hood 30 has to be taken out of the pocket 21 and attached to the bag body, which is extremely bothersome.

Thus, many golfers who hate to attach and detach the hood every time the weather changes tend to keep the hood attached to the bag body. That is, even when it is not raining, the hood is only partially attached to the bag so that clubs can be put into and taken out of the bag through the top opening. In this state, only part of the hood 30 is attached to the bag by the buttons 30*a* or the Velcro fastener, so that the hood can easily come off the bag and be lost. Since such a hood 30 has a rather special shape for a particular bag, nothing can substitute therefor if lost.

An object of this invention is to provide a golf bag having a means for protecting the interior of the bag and the golf clubs therein from rain, which means is designed such that it will not be an obstacle when clubs are inserted into or taken out of the bag when it is not raining.

SUMMARY OF THE INVENTION

According to this invention, there is provided a golf bag comprising a cylindrical body having a top opening, a flap detachably mounted on the cylindrical body at top end thereof for closing the top opening, the flap being formed with holes, tubular cases for woods inserted in the respective holes, the tubular cases being shaped such that shafts of the woods can pass therethrough, and bag members mounted on ends of the tubular cases protruding from the flap for covering heads of the woods, each of the bag members having an opening through which a wood can pass.

Unlike the conventional detachable hood, the claimed means for protecting the inside of the bag and the clubs therein from rain is not detachable from the body, so that there is no possibility of it being lost. This means or flap can be closed with the woods in the bag. The claimed tubular cases and bag members protect the protruding ends of the woods from rain.

The flap may be inclined relative to an axis of the cylindrical body so that the holes are located near the top of the flap. With this arrangement, it is possible to vary the distance between the inner surface of the flap and the inner bottom of the body, i.e. the depth of the inner space of the bag. This makes it possible to put longer putters and irons in a deeper portion of the interior space of the bag and shorter ones in a shallow portion (by e.g. partitioning the interior space of the bag). With this arrangement, it is possible to shorten the distance between the inner surface of the flap and the heads of the clubs (putters and irons) and thus prevent the clubs from bouncing up and down in the bag. The wood heads protrude from the holes formed in the flap.

Other features and objects of the present invention will become apparent from the following description made with reference to the accompanying drawings, in which:

DETAILED DESCRIPTION OF THE PREFERRED EMBODIMENT

Figure 1:
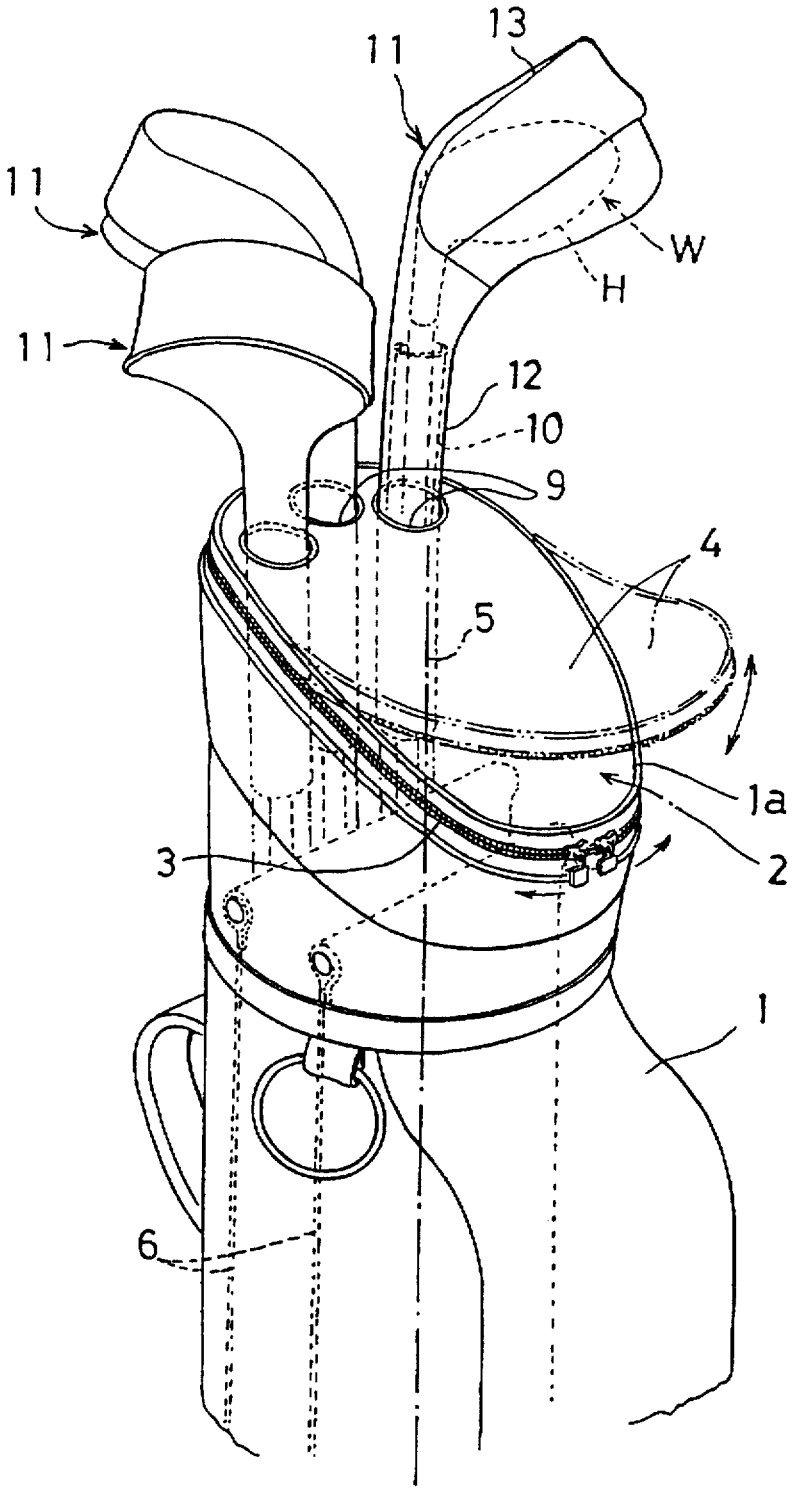
FIG. 1 is a partial perspective view of an embodiment.

FIGS. 1 and 2 show an embodiment of this invention. The same parts used in the prior art are denoted by the same numerals and their description is omitted. FIG. 1 shows the top 1*a* of a cylindrical body 1 of the golf bag of this embodiment. The bag body 1 has an opening 2 at its top 1*a*. The opening 2 is covered by a flap 4 which can be opened and closed by a zipper 3 provided along the edge of the opening 2. The body 1 is formed from a cylindrical resin plate covered with a weather-resistant sheet. The flap 4 is also made of the same weather-resistant sheet.

Figure 2A:
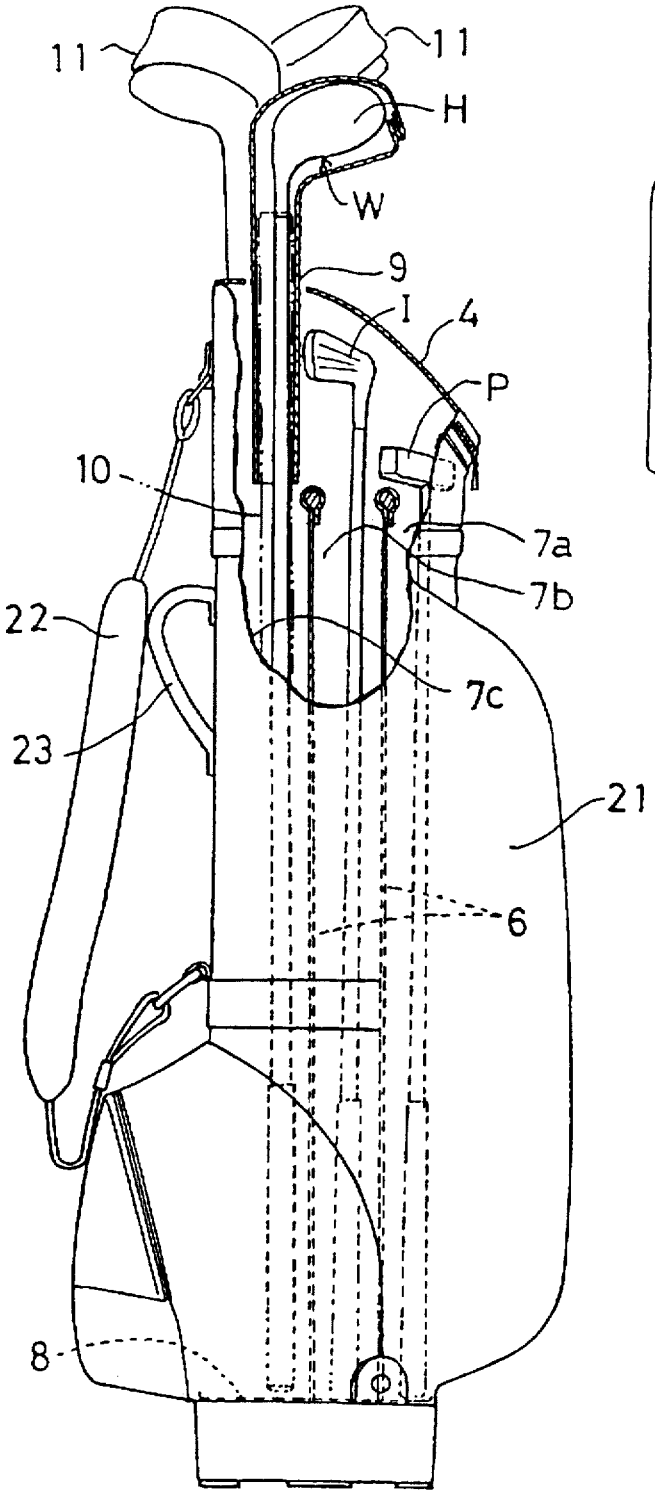
FIG. 2A is a partially cutaway side view of the embodiment.

The opening 2 at the top 1*a* is inclined a predetermined angle relative to the axis 5 of the cylindrical body. The flap 4 is also inclined relative to the axis 5. As shown in FIG. 2A, the interior of the body 1 is partitioned into three spaces 7*a*, 7*b* and 7*c* by two sheets 6 extending parallel to the axis 5.

Of these three spaces, the space 7*a*, which is the smallest in depth (distance between the inner surface of the flap 4 and the inner bottom 8 of the body 1) and the intermediate space 7*b* are the spaces for putters P and irons I. The space 7*b*, which is deeper than the space 7*a*but shallower than the space 7*c*, is for irons I. The inclined arrangement of the flap 4, its angle and the depths of the spaces 7*a*, 7*b* are determined such that the putters P and irons I will not bounce up and down so markedly in the respective spaces when the top opening is closed by the flap 4.

The woods W are received in the third space 7*c*. Since the flap 4 is inclined from the spaces for the putters P and irons I toward the space for the woods W, the space for the woods W is the deepest. But since the woods W are much longer than the putters P and irons I, it is impossible to cover the space for the woods W with the flap 4 even if the flap 4 is inclined in conformity with the difference in length between the shortest and longest ones of putters P and irons I. If the inclination of the flap 4 is increased so that all the spaces for the woods W, putters P and irons I can be closed by the flap 4, the distances between the inner surface of the flap 4 and the bottom ends of the spaces 7*a*, 7*b* for the putters P and irons I will be so long that the putters and irons can bounce up and down markedly in the respective spaces when the flap 4 is closed.

In this embodiment, in order to prevent the putters P and irons I from bouncing markedly when the respective spaces are closed by the flaps 4 with the woods W received in the corresponding space, holes 9 are formed in the flap 4 at portions right over the space 7*c* for the woods W so that the woods W can be inserted into and taken out of the space 7*c* through the holes 9. In order to prevent damage to the flap 4 when the woods W are slid through the holes 9, a resin pipe 10 is fitted in each hole 9. The heads H of the woods W as well as tops of the resin pipes 10 thus protrude from the top of the flap 4.

Figure 2B:
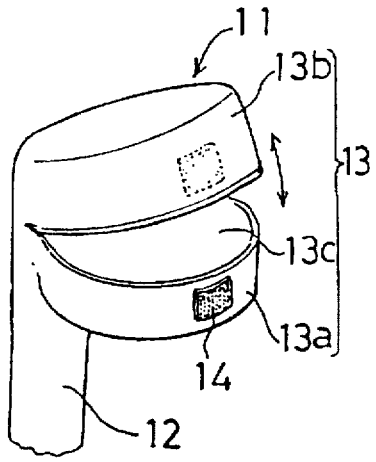
FIG. 2B is a perspective view of a wood head cover of the embodiment.
Figure 3:
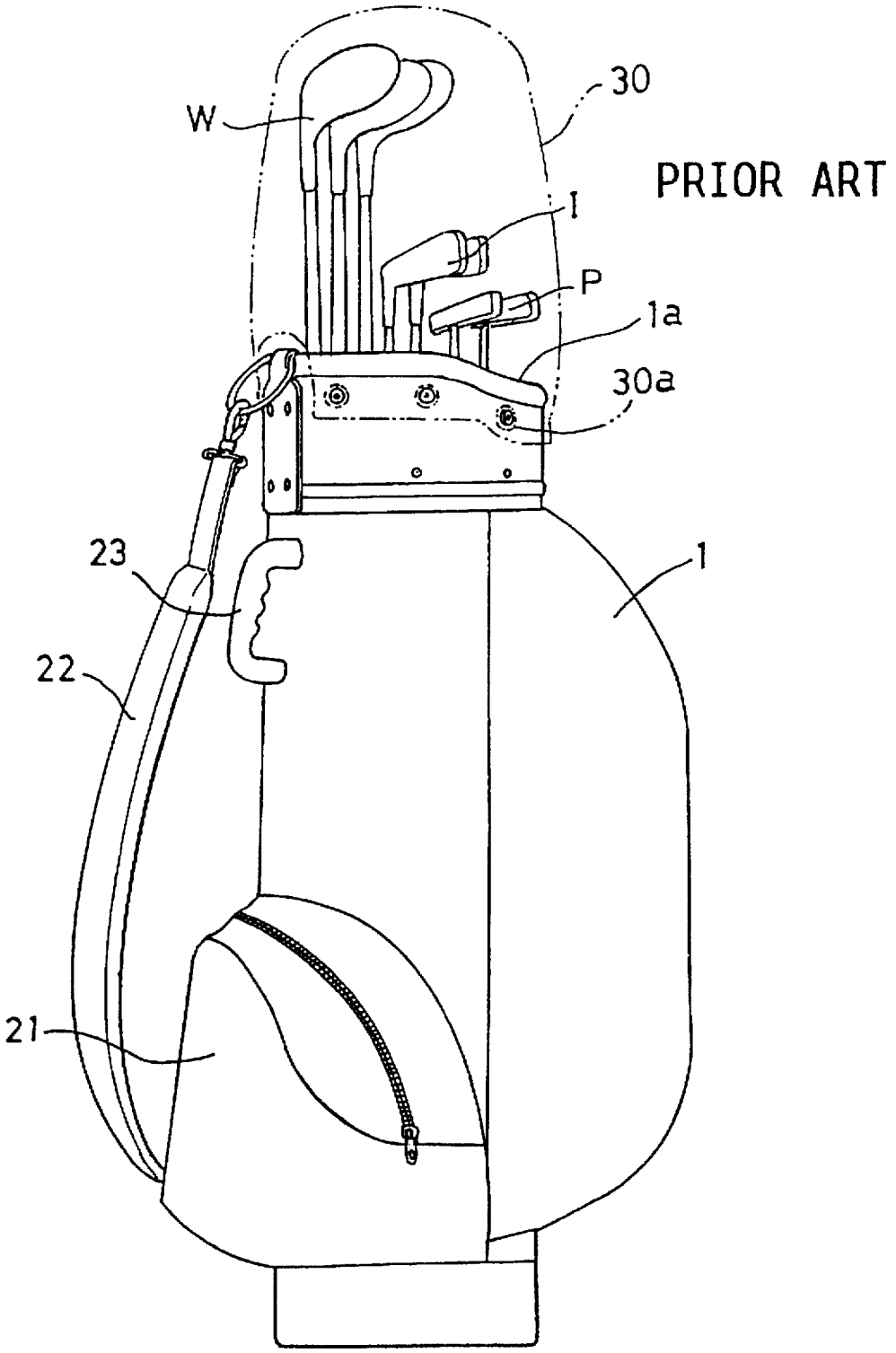
FIG. 3 is a side view of the prior art bag.

If no additional protective means is provided, the heads H of the woods W can get wet in the rain. Thus, in this embodiment, as shown in FIG. 2B, a head cover 11 formed of the same weather-resistant sheet as the outer sheet of the body 1 is attached to the top protruding end of each resin pipe 10. Each head cover 11 comprises a cylindrical portion 12 fitted around the resin pipe 10, and a bag portion 13 integral with the cylindrical portion 12 and enclosing the head H of each wood W.

The bag portion 13 comprises a lower portion 13*a*for receiving the lower portion of the head H and an upper portion 13*b* covering the upper portion of the head H. An opening 13*c*, is formed between the upper and lower portions 13*a*, 13*b*. A wood can be inserted into and pulled out of the bag through the opening 13*c*. Each head cover 11 can be closed by a Velcro fastener 14 provided near the opening 13*c*. The head covers 11 protect the heads of the woods W from rain.

According to this invention, the top opening of the golf bag is covered by the flap to protect the inside of the bag and the club therein from rain. This flap has not to be attached and detached every time the weather changes. There is no possibility of it being lost.

What is claimed is:

1. A golf bag comprising a cylindrical body having a top opening, a flap detachably mounted on said cylindrical body at said top opening for closing said opening, said flap being formed with holes therethrough, tubular cases for woods inserted in said respective holes, said tubular cases being shaped such that shafts of the woods are insertable therethrough, said tubular cases each having an end portion extending outwardly through said flap, and bag members mounted on said end portions of said tubular cases, each of said bag members having a reclosable opening through which a wood is insertable.

2. A golf bag of claim 1 wherein said flap is inclined relative to an axis of said cylindrical body, said holes being formed near the top of said flap.

* * * * *

UNITED STATES PATENT AND TRADEMARK OFFICE

CERTIFICATE OF CORRECTION

PATENT NO. : 5,779,042

DATED : July 14, 1998

INVENTOR(S) : Nariie Kaneko

It is certified that error appears in the above-identified patent and that said Letters Patent is hereby corrected as shown below:

Title page, item [30], under Foreign Priority insert --Japanese Application No. 9-118081, filed May 8, 1997.

Signed and Sealed this

Ninth Day of March, 1999

*Attest:*

*Attesting Officer*

Q. TODD DICKINSON

*Acting Commissioner of Patents and Trademarks*